United States Patent [19]

Ranghelli

[11] 4,382,260

[45] May 3, 1983

[54] TWO CHANNEL TRANSMIT ONLY ANTENNA

[75] Inventor: Joseph C. Ranghelli, Brooklyn, N.Y.

[73] Assignee: International Telephone and Telegraph Corporation, New York, N.Y.

[21] Appl. No.: 262,562

[22] Filed: May 11, 1981

[51] Int. Cl.[3] ..... H01Q 5/01

[52] U.S. Cl. ..... 343/730; 343/740; 343/844; 343/846

[58] Field of Search ..... 343/727, 730, 740, 844, 343/846

[56] References Cited

U.S. PATENT DOCUMENTS 3,789,412 1/1974 Keenan et al. ..... 343/730

*Primary Examiner*—Eli Lieberman

*Attorney, Agent, or Firm*—John T. O'Halloran; Alfred C. Hill

[57] ABSTRACT

The two channel transmit only antenna includes a balanced antenna and a ground plane disposed between the two radiators of the balanced antenna. The two radiators are fed by a three wire arrangement having one conductor connected to ground and the ground plane and two conductors each connected to a different one of the two radiators. A first channel filter is coupled between a first source providing a first transmit signal in a first frequency channel and one of the two conductors and a second filter is coupled between a second source providing a second transmit signal in a second frequency channel and the other of the two conductors. At least one resistor is connected between the two radiators. The two radiators are excited by an associated one of the two transmit signals having the same potential and the two radiators and the ground plane provide two monopole antennas back to back for independent transmission of the first and second transmit signals while the two radiators operate in a dipole mode in response to received signals to isolate the first and second sources from the received signals. The channel filters also assist in the isolation of the received signals from the source of transmitted signals, suppress transmitter current flow in the resistor, and block the transmitter current flow between the first and second channels.

22 Claims, 7 Drawing Figures

TWO CHANNEL TRANSMIT ONLY ANTENNA

BACKGROUND OF THE INVENTION

The present invention relates to antennas and more particularly to a two channel transmit only antenna.

SUMMARY OF THE INVENTION

An object of the present invention is to provide a two channel transmit only antenna having suppression of received and mutually coupled signals.

A feature of the present invention is the provision of a two channel transmit only antenna comprising a balanced antenna having two radiators; a ground plane disposed between the two radiators; at least one resistor connected between the two radiators; a three wire type feed system for the two radiators having one conductor connected to ground and the ground plane and two conductors each connected to a different one of the two radiators; a first two terminal source of a first transmit signal disposed in a first frequency channel having one terminal thereof connected to the one conductor; a second two terminal source of a second transmit signal disposed in a second frequency channel independent of the first channel having one terminal thereof connected to the one conductor; a first channel filter coupled between the other terminal of the first source and one of the two conductors; and a second channel filter coupled between the other terminal of the second source and the other of the two conductors.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
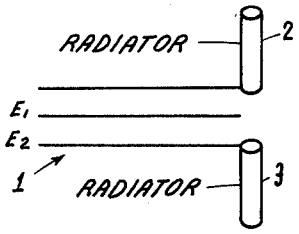
FIGS. 1–5 illustrate schematic equivalent circuit diagrams useful in explaining the operation of the present invention.
Figure 2:
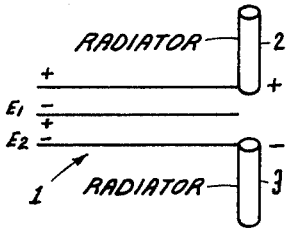
Figure 3:
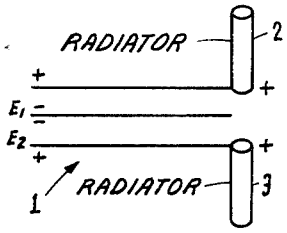
Figure 4:
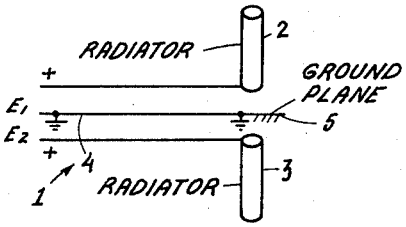
Figure 5:
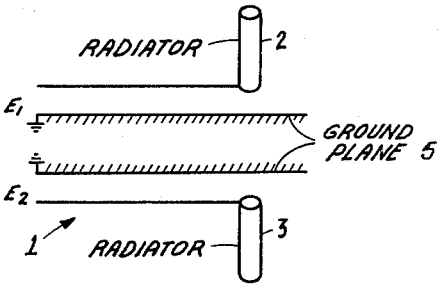

For a transmit only antenna, intermodulation of transmit signals by received signals (interference) can be reduced by use of a dual channel antenna. From FIGS. 1, 2, and 3 it is seen that a three wire feed system to a balanced antenna having two radiators 2 and 3 has two possible modes of operation: (1) an even mode with equal polarity voltages as shown in FIG. 3, and (2) an odd mode with opposite polarity voltages as shown in FIG. 2. The odd mode of FIG. 2 is the normal dipole mode with the center wire at an equi-potential plane and, therefore, transparent. The even mode operation of FIG. 3 will not support a normal dipole mode but can be forced to radiate if the center wire 4 is connected to a ground plane 5 as shown in FIG. 4, which thereby forms two monopole antennas back to back as illustrated in FIG. 5. By grounding the center conductor 4, each monopole antenna can be independently driven at any frequency via separate coaxial cables.

Since received signals are constrained as plane waves, only the dipole mode is possible on reception. Therefore, if transmission is restricted to the dual monopole mode and received to the dipole mode, isolation of the dual transmitting channels from each other and external received signals is possible.

Figure 6:
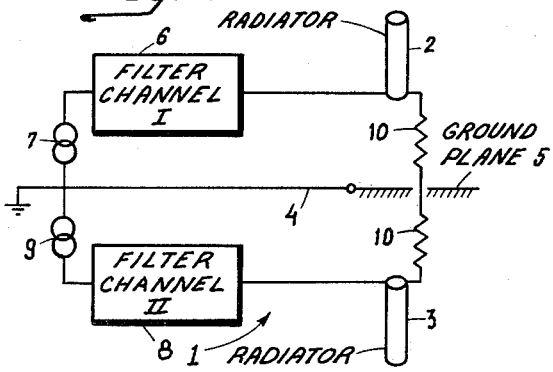
FIG. 6 is an equivalent circuit diagram of the transmit only antenna in accordance with the principles of the present invention.

FIG. 6 illustrates an equivalent circuit which exploits the difference of the dual monopole and dipole modes to achieve isolation of transmission and reception.

The transmit only arrangement includes the feed system 1 and the radiators 2 and 3 together with ground plane 4 operating as dual monopole antennas for transmitting. A channel filter 6 is coupled between source 7 and radiator 2 to enable transmission of a transmit signal in a first frequency channel and a channel filter 8 is coupled between source 9 and radiator 3 to enable transmission of a transmit signal in a second frequency channel independent of the first frequency channel. One or two resistors 10 are connected between the radiators 2 and 3. The channel filters 6 and 8 suppress their associated transmitter current flow in resistors 10 and suppress the loss of transmitter power (i.e. return current is blocked by the opposite channel filter in its stop band). Similarly, on receive one or both of the filters 6 and 8 are in a stop band which suppresses current loops into the sources 7 and 9 when a signal is received on radiators 2 and 3 in the dipole mode.

A further advantage is the suppression of mutual coupled signals between the monopoles in the transmit mode when a finite ground plane 5 is used. This occurs because the currents induced in the opposite monopole combined with a component of the original monopole current by vector resolution to form a dipole mode which is absorbed in resistors 10 as for received signals. The remaining vector is then the transmitted signal.

Figure 7:
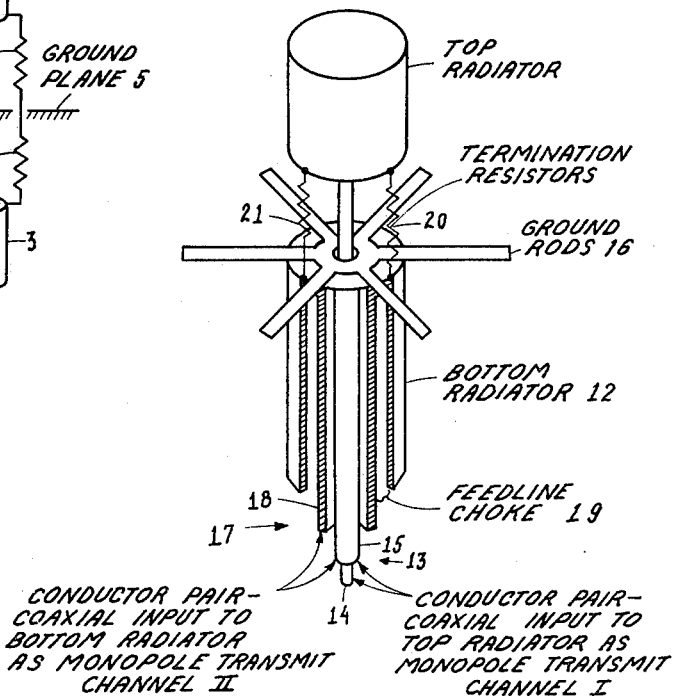
FIG. 7 is a perspective elevational view, partially in section, of one embodiment of the transmit only antenna of the present invention.

FIG. 7 illustrates one embodiment of the antenna system of FIG. 6. This embodiment includes a top radiator 11 and a bottom radiator 12 spaced from radiator 11 and coaxial with the longitudinal axis of radiator 11. Radiators 11 and 12 may be dipole radiators but may be any type of antenna capable of a monopole/dipole excitation (i.e. biconical, etc.). Top radiator 11 is fed by a conductor pair including the coaxial line 13 having an inner conductor 14 extending to top radiator 11 within radiator 12 coaxial of the axis of radiators 11 and 12 and an outer conductor 15 extending to a point between radiators 11 and 12. To the end of the outer conductor 15 at the point between radiators 11 and 12 are connected round rods 16 which extend outwardly from outer conductor 15 to provide ground plane 5 of FIG. 6. Bottom radiator 12 is fed by a coaxial line 17 which extends to the top of bottom radiator 12 coaxial of the axis thereof with coaxial line 17 being formed by a cylinder 18 acting as the outer conductor encircling outer conductor 15 of coaxial line 13 with outer conductor 15 of coaxial line 13 acting as the inner conductor of coaxial line 17. A feedline choke 19 is provided between cylinder 18 and radiator 12. Resistors 10 of FIG. 6 are provided by resistors 20 and 21 in FIG. 7 connected between the adjacent ends of radiators 11 and 12.

The filters 6 and 8, sources 7 and 9 and center wire 4 of FIG. 6 would be appropriately connected to coaxial lines 13 and 17 on FIG. 7 to provide the necessary excitation arrangement of the two channel transmit only antenna of the present invention.

While I have described above the principles of my invention in connection with specific apparatus, it is to be clearly understood that this description is made only by way of example and not as a limitation to the scope of my invention as set forth in the objects thereof and in the accompanying claims.

I claim:

1. A two channel transmit only antenna comprising:
a balanced antenna having two radiators;
a ground plane disposed between said two radiators;
at least one resistor connected between said two radiators;
a three wire type feed system for said two radiators having one conductor connected to ground and said ground plane and two conductors each connected to a different one of said two radiators;
a first two terminal source of a first transmit signal disposed in a first frequency channel having one terminal thereof connected to said one conductor;
a second two terminal source of a second transmit signal disposed in a second frequency channel independent of said first channel having one terminal thereof connected to said one conductor;
a first channel filter coupled between the other terminal of said first source and one of said two conductors; and
a second channel filter coupled between the other terminal of said second source and the other of said two conductors.

2. An antenna according to claim 1, wherein
said two radiators are excited by an associated one of said transmit signals having the same potential.

3. An antenna according to claim 2, wherein
said two radiators and said ground plane provide two monopole antennas back to back for independent transmission of said first and second transmit signals.

4. An antenna according to claim 3, wherein
said two radiators operate in a dipole mode in response to signals being received to isolate said first and second sources from said received signals.

5. An antenna according to claim 4, wherein
said received signals are absorbed in said resistor.

6. An antenna according to claim 5, wherein
said first and second filters each have operating characteristics to suppress transmitter current flow in said resistor and a stop band to block transmitter current flow from the other of said first and second channels and to suppress current flow resulting from said received signals.

7. An antenna according to claim 1, wherein
said two radiators are excited by an associated one of said transmit signals having the same potential.

8. An antenna according to claim 7, wherein
said two radiators operate in a dipole mode in response to signals being received to isolate said first and second sources from said received signals.

9. An antenna according to claim 8, wherein
said received signals are absorbed in said resistor.

10. An antenna according to claim 9, wherein
said first and second filters each have operating characteristics to suppress transmitter current flow in said resistor and a stop band to block transmitter current flow from the other of said first and second channels and to suppress current flow resulting from said received signals.

11. An antenna according to claim 1, wherein
said two radiators operate in a dipole mode in response to signals being received to isolate said first and second sources from said received signals.

12. An antenna according to claim 11, wherein
said received signals are absorbed in said resistor.

13. An antenna according to claim 12, wherein
said first and second filters each have operating characteristics to suppress transmitter current flow in said resistor and a stop band to block transmitter current flow from the other of said first and second channels and to suppress current flow resulting from said received signals.

14. An antenna according to claim 1, wherein
received signals are absorbed in said resistor.

15. An antenna according to claim 14, wherein
said first and second filters each have operating characteristics to suppress transmitter current flow in said resistor and a stop band to block transmitter current flow from the other of said first and second channels and to suppress current flow resulting from said received signals.

16. An antenna according to claim 1, wherein
said first and second filters each have operating characteristics to suppress transmitter current flow in said resistor and a stop band to block transmitter current flow from the other of said first and second channels and to suppress current flow resulting from received signals.

17. An antenna according to claims 1, 7, 11, 14, or 16, wherein
said two radiators include a top radiator having a longitudinal axis and a bottom radiator coaxial of said axis spaced from said top radiator,
said feed system includes a first coaxial line coaxial of said axis extending through said bottom radiator, said first coaxial line having an outer conductor extending to a point between said top radiator and said bottom radiator and an inner conductor extending to said top radiator, and a second coaxial line coaxial of said axis extending to the top of said bottom radiator having said outer conductor of said first coaxial line as its inner conductor and an outer conductor in the form of a cylinder surrounding said outer conductor of said first coaxial line; and
said ground plane includes a plurality of ground rods connected to and extending radially outward from said outer conductor of said first coaxial line at said point.

18. An antenna according to claim 17, further including
a choke for said feed system including the space between said cylinder forming said outer conductor of said second coaxial line and said bottom radiator.

19. An antenna according to claim 18, wherein
said resistor is connected between adjacent ends of said top and bottom radiators.

20. An antenna according to claim 19, wherein
two of said resistors are provided.

21. An antenna according to claim 17, wherein
said resistor is connected between adjacent ends of said top and bottom radiators.

22. An antenna according to claim 17, wherein
two of said resistors are provided each of which is connected between adjacent ends of said top and bottom radiators.

* * * * *